United States Patent [19]

Weisang

[11] Patent Number: 4,891,063

[45] Date of Patent: Jan. 2, 1990

[54] PROCESS FOR STIRRING STEEL IN A LADLE WITH THE AID OF CARBON DIOXIDE

[75] Inventor: Francois Weisang, Antony, France

[73] Assignee: L'Air Liquide, Paris, France

[21] Appl. No.: 229,440

[22] Filed: Aug. 8, 1988

[30] Foreign Application Priority Data

Aug. 12, 1987 [FR] France ..... 87 11458

[51] Int. Cl.[4] ..... C21C 5/32; C21C 5/34

[52] U.S. Cl. ..... 75/51.1; 75/51.3; 75/51.7; 75/59.3; 75/59.22

[58] Field of Search ..... 75/51.1, 59.3, 59.22, 75/51.3, 51.7

[56] References Cited

U.S. PATENT DOCUMENTS

| | | | |
|---|---|---|---|
| 3,575,695 | 4/1971 | Miyashita | 75/51.7 |
| 3,729,309 | 4/1973 | Kawawa | 75/129 |
| 3,971,655 | 7/1976 | Takashima | 75/51.7 |
| 4,036,635 | 7/1977 | Klapdar | 75/51.7 |
| 4,238,227 | 12/1980 | Golas et al. | 75/58 |
| 4,456,477 | 6/1984 | Masuda | 75/59.22 |

FOREIGN PATENT DOCUMENTS 882149 3/1980 Belgium .

OTHER PUBLICATIONS

Patent Abstracts of Japan, vol. 8, No. 273, Dec. 13, 1984.

*Primary Examiner*—Peter D. Rosenberg
*Attorney, Agent, or Firm*—Lee C. Robinson, Jr.

[57] ABSTRACT

A killed steel is stirred in a ladle with the aid of gaseous carbon dioxide. Before the beginning of the stirring in the ladle, there is added to the quantity of deoxidizer usually employed, a supplementary quantity of deoxidizer in the molten metal, the rate of supply of carbon dioxide, bearing in mind the capacity of the ladle and the duration of the stirring, remaining less than or equal to the maximum rate of supply corresponding to the oxidation of the supplementary quantity of deoxidizer at the end of the stirring.

6 Claims, No Drawings

PROCESS FOR STIRRING STEEL IN A LADLE WITH THE AID OF CARBON DIOXIDE

The present invention relates to a process for stirring steel in a ladle comprising injecting an inert gas into a bath of molten steel, this injection being such that bubbles of gas rise through at least a part of the bath of molten metal and burst on the surface of the latter, thereby putting the molten metal in motion as the gas rises, said bath of steel having been previously killed for the incorporation of a deoxidizer in a sufficient amount to ensure that an excess of the latter remains in the state dissolved in the bath.

In order to improve the productivity and the quality, steel manufacturers have developed a metallurgy, termed secondary metallurgy or metallurgy in a ladle. The essential purpose of this metallurgy is the thermal control and the analytical control of the metal. As concerns the thermal control, the stirring permits a cooling and a homogenization. As concerns the analytical control, the stirring permits achieving the homogenization, the grading of the steel, the deoxidization, the control of the cleanness of the metal, the control of the inclusions, the desulphurization, the dephosphorization, etc. It has also been found that use of electric arcs for heating in a ladle for example, or of a vacuum for achieving the degassing in this ladle was improved by a stirring of the metal. Among the various stirring methods employed, the stirring with injection of gas is very common, since it requires only a small investment and is very simple to use.

Before stirring, the effervescent steel is killed by incorporation of a deoxidizer such as aluminium and/or silicon, which permits eliminating or reducing the residual oxygen present in the bath of steel. In order to maintain a content of oxygen dissolved in the steel which is compatible with the pouring conditions, an excess of deoxidizer is usually incorporated in the bath of steel. This excess of deoxidizer is usually less than 1500 ppm and preferably between 100 and 500 ppm for the aluminium and between 200 and 1000 ppm for the silicon. According to the desired grade of the steel, the content of deoxidizer dissolved is fixed and controlled at about ±20 ppm. The stirring amounts to putting the metal in motion by entraining the metal along with the rising gas. The intensity of the stirring is characterized by a physical magnitude corresponding to the power per metric ton of metal.

It is known to employ neutral gases, such as argon or nitrogen, for carrying out the stirring in a ladle. In a number of applications, nitrogen may not be employed, since it is desired to produce a steel having a low nitrogen content. Heretofore, only argon could be employed for the gaseous stirring in ladles when it is in particular desired to obtain steels having a low nitrogen content. However, the use of argon is sometimes limited by economic requirements, bearing in mind the high cost of this gas.

Research was therefore carried out to ascertain whether it was possible to employ for effecting this stirring another gas which has a substantially inert behaviour with regard to the steel and is cheap to use.

A priori, one skilled in the art has a tendency to rule out the possibility of using carbon dioxide gas for effecting a stirring in a ladle, since it is known from the article entitled "Emprego de $CO_2$ na Descarburacao do Aco en Formo Electrico—Renato Augusto Barbosa—Getulio Sergio da Silva—METALURGIA—vol. 28—N° 172—MARCO, 1972" that carbon dioxide at the temperature of a bath of molten steel, i.e. on the order of 1600° C, decomposes into oxygen and carbon monoxide which are oxidizing with regard to steel. Surprisingly, it has been found that it was possible to employ carbon dioxide for effecting the stirring of a killed steel in a ladle, notwithstanding the oxidizing character of carbon dixoide in the conditions of use, and to achieve an economical stirring.

The process according to the invention is characterized in that it comprises, before starting the stirring in the ladle, adding to the excess deoxidizer a supplementary quantity of deoxidizer in the bath of molten metal, and thereafter effecting the stirring of the molten metal by the injection of carbon dioxide in the gaseous form, the rate of supply of carbon dioxide in the gaseous form, bearing in mind the capacity of the ladle and the duration of the stirring, remaining lower than or equal to the maximum rate of supply corresponding to the oxidation of the supplementary quantity of deoxidizer. Preferably, the supplementary quantity of deoxidizer will be less than or equal to 10% of the excess deoxidizer. It has been found that this value of 10% was the maximum value permitting a control of the content of deoxidizer of the steel according to the predetermined grade. The rate of supply of carbon dioxide per metric ton of stirred steel is usually less than or equal to 10 liters per minute.

Thorough studies carried out have revealed the factors which affect the loss of deoxidizer in the course of the stirring, this deoxidizer usually being very reactive with regard to the iron oxide surrounding the bubbles of gas, thereby resulting in the formation of oxides. Now, deoxidizers are of very high cost and one of the objects of the invention is to inject carbon dioxide under certain conditions to achieve a stirring of the molten metal producing a loss of deoxidizer whose cost remains lower than the saving achieved by the use of carbon dioxide which is cheaper than argon. Furthermore, it is found, surprisingly, that although oxides are produced in the metal in the course of stirring with carbon dioxide, these oxides do not result in a deterioration of the cleanness of the finished product.

Thus it was possible to show the importance of the following parameters when stirring a steel with a gas: the nature of the stirred steel, i.e. the composition desired at the end of the stirring, the nature and quantity of deoxidizer employed at the beginning of the stirring and the quantity of deoxidizer required upon pouring after treatment in the ladle, the dimensions of the ladle (height, diameter) and the quantity of treated metal, the type of gas injector employed and its hydraulic characteristics, the gas employed, the injected rate of supply and the duration of the treatment.

The supplementary quantity of deoxidizer to be added in the steel before stirring must be capable of being determined as a function of the geometry of the ladle, the duration of the stirring in this ladle and the rate of supply of the carbon dioxide employed.

According to a preferred first embodiment of the process according to the invention, in which a nozzle is used for injecting the carbon dioxide gas in the bath, the process is characterized in that the rate of supply Q of the carbon dioxide gas is such that the following relation is satisfied:

$$B^{1.42} \times \left(\frac{Q}{W}\right)^{0.66} \times t \leqq 35$$

in which relation:

B is the ratio between the length of nozzle immersed in the bath and the height of metal in the ladle, Q is the rate of supply of carbon dioxide in liters per min, W is the capacity of the ladle in metric tons, t is the stirring time in minutes.

In this case, the supplementary quantity $m_{sup.}$ (expressed in kg) of deoxidizer to be added in the ladle before stirring is less than or equal to:

$$m_{sup} \leqq 3 \times \frac{Do}{R} \times B^{1.42} \times Q^{0.66} \times W^{0.36} \times t$$

Do being the desired content of deoxidizer at the end of the stirring expressed as a %, R being the yield of the addition of the killing deoxidizer expressed as a %, B being the ratio between the immersed length of the nozzle and the height of the metal, Q being the rate of supply of carbon dioxide in liters per min, W being the capacity of the ladle in metric tons, t being the stirring time in minutes.

According to a preferred second embodiment of the invention in which a porous plug is used for injecting carbon dioxide gas in the bath of molten metal, the process is characterized in that the rate of supply Q of carbon dioxide is such that the following relation is satisfied:

$$Q^{0.25} \times W^{-0.64} \times S^{0.33} \times t \leqq 10$$

In which formula:

Q is the rate of supply of injected gas in l/min,

W is the capacity of the ladle in metric tons,

S is the active surface of the plug in contact with the steel in sq.cm, t is the stirring time in minutes.

In the case of a porous plug, a supplementary quantity $m_{sup.}$ of deoxidizer to be added in the bath of molten metal is equal to:

$$m_{sup} \leqq 4 \times \frac{Do}{R} \times Q^{0.25} \times W^{0.36} \times S^{0.33} \times t,$$

In which formula:

Do is the desired content of deoxidizer at the end of the stirring expressed as a %, R is the yield of the addition of killing deoxidizer expressed as a %, Q is the rate of supply of carbon dioxide expressed in liters/min., W is the capacity of the ladle in metric tons, t is the stirring time in minutes, S is the active surface of the porous plug in contact with the steel expressed in sq.cm.

According to a preferred third embodiment of the invention, in which the gas is injected into the ladle by means of an injector in which the gas passes through a space provided between the non-porous refractory blocks, the gas passage section being controlled either by grooves in the refractory blocks or preferably by a series of metal tubes of small diameter and of circular or flattened sections, the process is characterized in that the rate of supply Q of the carbon dioxide in the bath of metal is such that the following relation is satisfied:

$$Q^{0.25} \times W^{-0.64} \times S^{0.33} \times t \leqq 7$$

In which formula:

Q is the rate of supply of carbon dioxide expressed in liters/min.,

W is the capacity of the ladle in metric tons, t is the stirring time in minutes, S is the wetted section in sq.cm. which, in the case of circular tubes, is equal to:

$$S = N \times \frac{\pi(d + 0.05)^2}{4}$$

whereas, in the case of grooves or flattened tubes:

$$S = N \times (L + 0.05) \times (1 + 0.05),$$

N being the number of elementary passages in an injector, d being the inside diameter of the tube in use, L and l being respectively the largest length and the largest width of the groove expressed in cm.

In the case of injection by the means of injector as defined hereinbefore, the supplementary quantity m of deoxidizer to be added in the molten metal is given by the same formula as in the case of porous plugs, the surface S being then calculated according to either one of the aforementioned formulae.

A better understanding of the invention will be had from the following examples of carrying out the invention which are intended to be non-limitative:

EXAMPLE 1

A stirring is carried out in a ladle of 180 metric tons by means of a nozzle immersed to the extent of three quarters of the height of the bath of molten steel. This stirring is carried out with a rate of supply of carbon dioxide gas of 200 liters per min. for 8 minutes. The yield R of the addition of the aluminium is 50%. The desired content of aluminium at the end of the stirring is 0.02%.

The calculated quantity of supplementary aluminium m is equal to 1.37 kg.

By adding this supplementary quantity of aluminium before the stirring effected as indicated before, it is checked, by analyzing a sample taken off at the end of the stirring, that the content of aluminium of the steel is in fact 0.02% (200ppm).

EXAMPLE 2

The same experiment as in the case of Example 1 is carried out by using a porous plug placed in the bottom of the ladle whose active surface is 190 sq. cm.

The supplementary quantity m of aluminium to be added, calculated in accordance with the aforementioned formula, is equal to 1.76 kg.

By effecting the stirring in accordance with the indications given hereinbefore by adding before the beginning of the stirring a quantity of 1.76 kg of aluminium in the bath of steel, it is found by the analysis of a sample taken from the bath at the end of the stirring, that the content of aluminium of the sample is in fact 0.02% (200 ppm).

EXAMPLE 3

A stirring is effected under the same conditions as before by means of an injector constituted by tubes of small diameters whose equivalent diameter does not exceed 3 mm. A section equal to 0.7 sq. cm. is used.

The quantity of aluminium to be added, calculated in accordance with the aforementioned formula, is 1.27 kg. By carrying out the stirring in accordance with the indications given hereinbefore, a sample taken off at the end of the stirring does in fact contain a content of aluminium equal to 0.02% (200 ppm).

Generally, it will be noted that in the course of the treatment of the metal in the ladle according to the process described hereinbefore, it may be found preferable or necessary to render the surface of the bath of the steel inert throughout the duration of the stirring. In particular, this may be found necessary if a low content of nitrogen in the treated steel is desired to be conserved. This surface may be rendered inert by injection of argon, nitrogen (when the latter is not to be excluded) or carbon dioxide above or on the surface of the bath of metal. For the first two gases mentioned, the surface may be rendered inert by means of a gas or a liquid. As concerns carbon dioxide, the surface may be rendered inert by means of a gas or carbon dioxide snow.

I claim:

1. A process for stirring killed steel in a ladle, comprising injecting an inert gas into a bath of molten steel in the ladle, said injecting being so effected that bubbles of gas rise through at least a part of the bath of molten steel thereby putting the molten steel in motion by the effect of the rising gas, said bath of molten steel having previously been killed by incorporating a sufficient quantity of deoxidizer that an excess of the deoxidizer remains in the dissolved state in the bath of molten steel, said process further comprising adding a supplementary quantity of deoxidizer to the excess of deoxidizer in the bath of molten steel and thereafter effecting the stirring of the molten steel by injecting carbon dioxide in a gaseous form, the rate of supply of carbon dioxide in the gaseous form remaining at the most equal to 10% of the excess of dissolved deoxidizer.

2. A process according to claim 1, comprising employing a nozzle for injecting the gaseous carbon dioxide into the bath of molten steel, the rate of supply Q of the gaseous carbon dioxide being such that the following relation is satisfied:

$$B^{1.42} \times \left(\frac{Q}{W}\right)^{0.66} \times t \leqq 35$$

In which relation:

B is the ratio between the immersed length of the nozzle in the bath and the height of the steel in the ladle, Q is the rate of supply of carbon dioxide in liters/min., W is the capacity of the ladle in metric tons, t is the stirring time in minutes.

3. A process according to claim 1, comprising employing a porous plug placed in a lower wall of the ladle for injecting the gaseous carbon dioxide into the bath, the rate of supply Q of gaseous carbon dioxide being such that the following relation is satisfied:

$$Q^{0.25} \times W^{-0.64} \times S^{0.33} \times t \leqq 10$$

In which relation:

Q is the rate of supply of injected gas in liters/min.,

W is the capacity of the ladle in metric tons,

S is the active surface of the plug in contact with the steel in sq.cm., t is the stirring time in minutes.

4. A process according to claim 1, comprising employing injectors for injecting the gaseous carbon dioxide into the bath of molten steel, the rate of supply Q of gaseous carbon dioxide being such that the following relation is satisfied:

$$Q^{0.25} \times W^{-0.64} \times S^{0.33} \times t \leqq 7$$

In which relation:

Q is the rate of supply of carbon dioxide in liters/min.,

W is the quantity of steel treated in the ladle, expressed in metric tons, t is the stirring time in minutes, S is the wetted section in sq.cm. which, in the case of circular tubes, is equal to:

$$S = N \times \frac{\pi(d + 0.05)^2}{4}$$

Whereas, in the case of grooves or flat tubes:

$$S = N \times (L + 0.05) \times (1 + 0.05),$$

N being the number of elementary passages in an injector, d being the inside diameter of the tube in centimeters, L and 1 being respectively the largest length and the largest width of the groove expressed in centimeters.

5. A process according to claim 2, wherein the supplementary quantity of deoxidizer $m_{sup.}$ to be added is at the most equal to:

$$m_{sup} \leqq 3 \times \frac{Do}{R} \times B^{1.42} \times Q^{0.66} \times W^{0.36} \times t$$

Do being the desired content of deoxidizer at the end of the stirring expressed as a %, R being the yield of addition of killing aluminium expressed as a %, B being the ratio between the immersed depth of the nozzle and the height of the steel, Q being the rate of supply of the carbon dioxide in liters/min., W being the capacity of the ladle in metric tons, t being the stirring time in minutes.

6. A process according to claim 3, wherein the supplementary quantity of deoxidizer to be added is at the most equal to:

$$m_{sup} \leqq 4 \times \frac{Do}{R} \times Q^{0.25} \times W^{0.36} \times S^{0.33} \times t,$$

Do being the desired content of deoxidizer at the end of the stirring expressed as a %, R is the yield of addition of the killing deoxidizer expressed as a %, Q is the rate of supply of carbon dioxide expressed as liters/min., W is the capacity of the ladle in metric tons, t is the stirring time in minutes, S is the active surface of the porous plug in contact with the steel expressed in sq.cm.

* * * * *